US005509180A

United States Patent [19]

Benetti et al.

[11] Patent Number: 5,509,180

[45] Date of Patent: Apr. 23, 1996

[54] BUCKLE FOR SKI BOOT

[75] Inventors: Cristiano Benetti, Paese; Denis Gallon, Belluno, both of Italy

[73] Assignee: Lange International S.A., Fribourg, Switzerland

[21] Appl. No.: 332,701

[22] Filed: Nov. 1, 1994

[30] Foreign Application Priority Data

Dec. 8, 1993 [CH] Switzerland ..... 3653/93

[51] Int. Cl.[6] ..... A43C 11/00

[52] U.S. Cl. ..... 24/68 SK; 24/70 SK; 24/71 SK

[58] Field of Search ..... 24/68 SK, 69 SK, 24/70 SK, 71 SK, 68 T; 36/50.1

[56] References Cited

U.S. PATENT DOCUMENTS

| | | | |
|---|---|---|---|
| 4,051,611 | 10/1977 | Chalmers . | |
| 4,470,175 | 9/1984 | Chiarella | 24/71 SK |
| 4,541,147 | 9/1985 | Olivieri | 24/68 SK |
| 4,683,620 | 8/1987 | Valsecchi et al. | 24/68 SK |
| 4,893,384 | 1/1990 | Bidoia et al. | 24/70 SK |
| 5,172,454 | 12/1992 | Martignago | 24/68 SK |

FOREIGN PATENT DOCUMENTS

| | | |
|---|---|---|
| 2534117 | 4/1984 | France . |
| 549356 | 5/1974 | Switzerland . |

*Primary Examiner*—Victor N. Sakran

*Attorney, Agent, or Firm*—Kane, Dalsimer, Sullivan, Kurucz, Levy, Eisele and Richard

[57] ABSTRACT

Buckle, comprising a tensioning lever (4) which is articulated onto a base (1) and has a longitudinal notch (6) in which a link rod (7), connected to a fastening member (10), is articulated. The notch (6) and the link rod (7) are laterally offset relative to the longitudinal mid-axis of the tensioning lever toward the side of the buckle which is intended to be arranged toward the rear of the boot, while the other side of the tensioning lever has a decreasing height forming a ramp (16, 16*a*) over which the slalom poles which the boot encounters can slide without risk of catching or opening the buckle.

3 Claims, 1 Drawing Sheet

BUCKLE FOR SKI BOOT

FIELD OF THE INVENTION

The subject of the present invention is a buckle for a ski boot, comprising a tensioning lever which is articulated onto a base and has a longitudinal notch in which a link rod, which is also connected to a fastening member, is articulated.

PRIOR ART

Such a buckle is described, for example, in U.S. Pat. No. 4,051,611.

Once it has been mounted on a ski boot, such a buckle forms a projection. Such a projection presents practically no problem for a skier not engaged in competition, but is, quite the contrary, problematic for a skier engaging in competition, especially slalom. During a slalom, the boot often encounters poles. A pole which strikes against the buckle can unbalance the skier and cause him/her to fall. The impact on the buckle can also cause it to open, or even to be torn off.

It is well known to equip the front part of the shell of the boot with a ramp-shaped projection placed in front of the buckles in order to deflect the pole so that it does not encounter the buckles.

It has also been proposed to equip the boot with an auxiliary member, for example a bar, in order to deflect the poles, as is described in Patent Application CH 1800/92.

The formation of a projection or deflector on the shell leads to an overthickness which complicates the molding operation.

SUMMARY OF THE INVENTION

The object of the invention is to produce a buckle which makes it possible to obtain the same deflection effect as with the projection of the shell, and thus to eliminate this projection.

A feature of the buckle according to the invention is that the notch of the tensioning lever, and consequently also the link rod, are laterally offset relative to the longitudinal mid-axis of the tensioning lever, toward the side of the buckle which is intended to be arranged toward the rear of the boot, and that the part of the tensioning lever located on the side opposite the notch has, over at least a part of its width, a height which decreases toward the side intended to be arranged toward the front of the boot.

This decreasing height may be obtained by a chamfer forming an inclined plane over which the pole will slide.

The lateral offset of the link rod makes it possible for the buckle to retain all the requisite strength in spite of the thinning of one of its sides.

Buckles are indeed already known which have some degree of assymetry, but only at one of their ends, for purely esthetic reasons.

BRIEF DESCRIPTION OF THE DRAWINGS

The attached drawing represents, by way of example, one embodiment of the invention.

The single view of the drawing represents a view thereof in perspective.

DESCRIPTION OF THE PREFERRED EMBODIMENT

Figure 1:
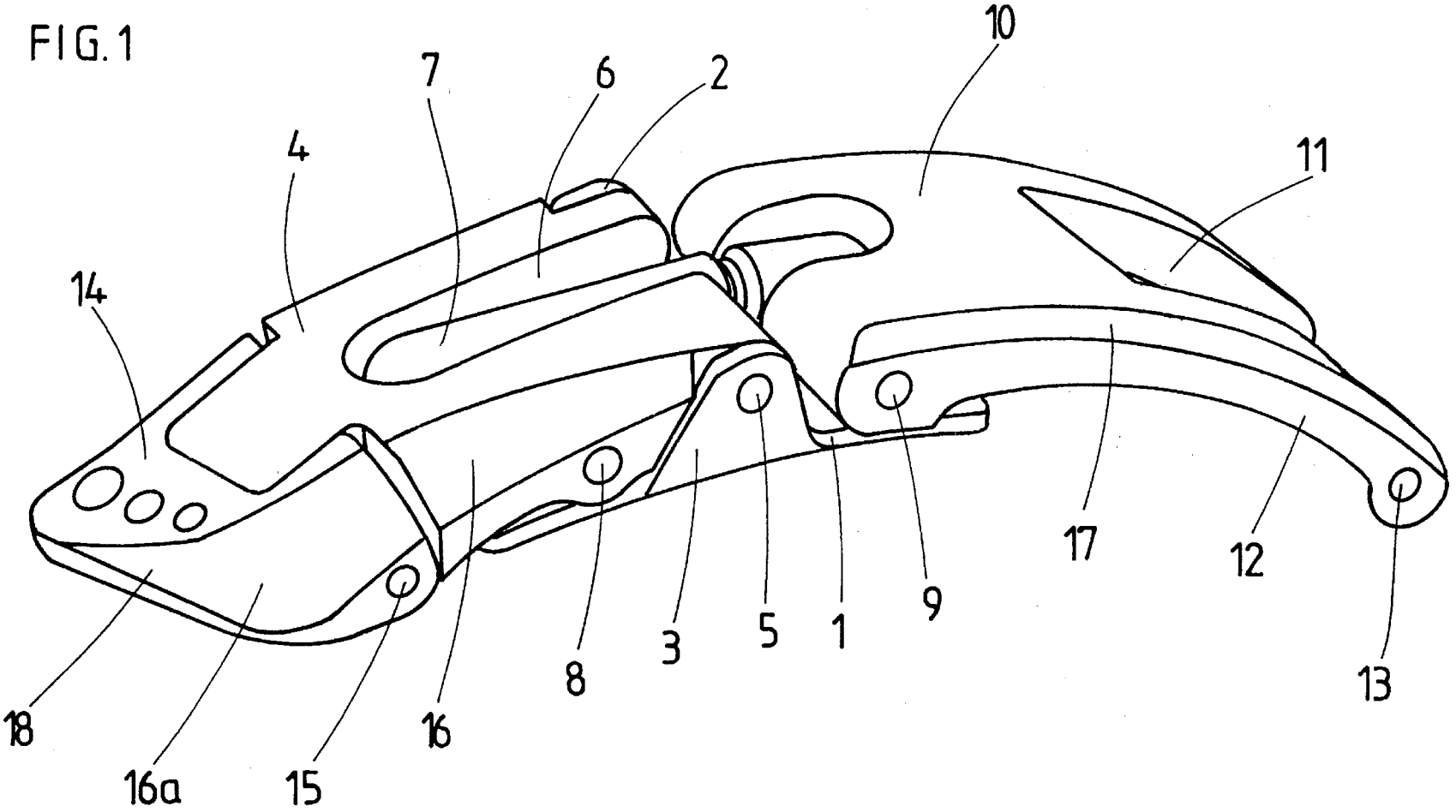

The drawing shows a base 1 intended to be fixed onto a ski boot shell by means of two rivets. This base 1 has two vertical lugs 2 and 3 onto which a tensioning lever 4 is articulated by means of two coaxial pins, one, 5, of which can be seen on the drawing. The tensioning lever has a deep notch 6 extending longitudinally from the articulation pin of the tensioning lever toward its end. In this notch, a link rod 7 is articulated about a pin 8 which passes through the tensioning lever. This link rod, whose length is adjustable, is connected by a pin 9 to a fastening member 10 which has two parallel arms 11 and 12 which are connected at their ends by a small transverse bar 13 intended to be fastened into teeth fixed on an opposite part of the shell of the boot. At its end, the tensioning lever 4 is also equipped with a short auxiliary lever 14 which is articulated onto the narrow end of the tensioning lever 4 about a pin 15. This auxiliary lever 14 is intended to facilitate gripping of the tensioning lever 4, while providing this tensioning lever with an end which tapers toward the surface of the boot, so as to prevent accidental catching of the end of the tensioning lever.

The notch 6 is laterally offset, relative to the longitudinal mid-axis of the tensioning lever, toward the side of the buckle which is intended to be arranged toward the rear of the boot. In addition, the opposite side of the buckle, that is to say the side of the buckle facing the front of the boot, has a chamfer 16 formed on the tensioning lever 4 and a corresponding chamfer 17 formed on the fastening member 10. The chamfer 16 also extends, of course, over the auxiliary lever 14, as indicated by the chamfer 16*a*. The end of the auxiliary lever 14 is also partially chamfered, as represented at 18. The chamfers 16, 17 and 18 form a ramp or an inclined plane such that, when a slalom pole strikes the buckle, it slides over this inclined plane and is thus moved away from the buckle without causing catching.

Instead of a chamfer, it is possible to provide a thickness which decreases progressively in the form of a rounded edge.

In the case in which the fastening member 10 is replaced by a simple rectangular ring of round cross section, only the tensioning lever, with or without auxiliary lever 14, has a lateral chamfer.

The notch and the link rod need not necessarily be offset laterally relative to the axis of symmetry of the base, and the offset relative to the mid-axis of the tensioning lever can be produced by adding a lateral ramp on one of the sides of the tensioning lever.

We claim:

1. A buckle for a ski boot, comprising a tensioning lever (4) which is articulated onto a base (1) and has a longitudinal notch (6) in which a link rod (7), which is also connected to a fastening member (10), is articulated, wherein the notch (6) of the tensioning lever, and consequently also the link rod (7), are laterally offset relative to the longitudinal mid-axis of the tensioning lever (4), toward the side of the buckle which is intended to be arranged toward the rear of the boot, and wherein the part of the tensioning lever located on the side opposite the notch has, over at least a part of its width, a height which decreases toward the side intended to be arranged toward the front of the boot.

2. The buckle as claimed in claim 1, wherein the decreasing height is given by a chamfer (16).

3. The buckle as claimed in claim 1, wherein the fastening member (10) also has a height which decreases from its side (17) corresponding to the side of the tensioning lever having decreasing height.

* * * * *